US005108189A

United States Patent [19]

Oswald

[11] Patent Number: 5,108,189

[45] Date of Patent: Apr. 28, 1992

[54] VIBRATOR AND RELATED METHOD

[76] Inventor: Fred Oswald, Forest Dr., Sands Point, N.Y. 11050

[21] Appl. No.: 585,691

[22] Filed: Sep. 19, 1990

[51] Int. Cl.[5] ..... B01F 11/00

[52] U.S. Cl. ..... 366/123

[58] Field of Search ..... 366/123, 128, 120, 121, 366/122, 117; 138/172, 174

[56] References Cited

U.S. PATENT DOCUMENTS

| | | | |
|---|---|---|---|
| Re. 21,684 | 1/1941 | Mall | 366/128 X |
| 1,989,409 | 1/1935 | Gordon | 366/123 X |
| 2,492,431 | 12/1949 | Kroeckel | 366/122 |
| 2,597,505 | 5/1952 | Lindkvist | 366/123 X |
| 2,603,459 | 7/1952 | McCrery | 366/122 |
| 2,705,618 | 4/1955 | Wyzenbeek | 366/122 |
| 3,042,386 | 7/1962 | Wyzenbeek | 366/122 |
| 3,109,461 | 11/1963 | Wolff et al. | 138/172 X |
| 3,119,275 | 1/1964 | Ambrosé | 366/128 X |
| 4,196,755 | 4/1980 | Kutnyak et al. | 138/174 X |
| 4,295,496 | 10/1981 | Bixby | 138/174 X |

*Primary Examiner*—Harvey C. Hornsby
*Assistant Examiner*—Scott J. Haugland
*Attorney, Agent, or Firm*—Ladas & Parry

[57] ABSTRACT

A vibrator is provided which includes a relatively rigid shell with a vibrating mechanism being provided within the shell to cause the same to vibrate. A flexible shaft is coupled to the vibrating mechanism to drive the same. Moreover, a cover is provided on the shell formed of a material softer than the shell whereby to lessen the effects of the impact of the shell on any encountered object such as a reinforcing rod. The cover is made, for example, of a plurality of rings arranged in axial series. The rings include projections and are provided with notches or receptacles for receiving the projections. The projections on respective of the rings are engaged in the receptacle of the next adjacent rings in the axial series. The vibrator may be inserted, for example, in a setting concrete to remove air and voids therefrom. The covering on the shell is intended to avoid chipping of, for example, epoxy coatings which are employed on reinforcing rods to avoid the corrosion of the same.

13 Claims, 4 Drawing Sheets

VIBRATOR AND RELATED METHOD

FIELD OF THE INVENTION

This invention relates to vibrators and more particularly to vibrators for use with concrete and the like. The invention also relates to methods of pouring and setting concrete in forms in which reinforcing rods are employed.

BACKGROUND

The pouring of low slump concrete into forms to build sidewalks, patios, roads, ramps, bridges, and the like is well known. Thus, for example, it is known to mix water with concrete powder and possibly other materials to obtain a stiff relatively dry slurry which can be poured into wooden forms or the like where the concrete sets and becomes self supporting.

It is also known to reinforce this low slump concrete by the use of reinforcing rods made of steel or the like, the rods being placed into the forms prior to the pouring of the concrete and being held in elevated altitude in the forms by feet or plastic inserts or such so that the rods are ultimately embedded in the set concrete.

It is further known to vibrate the concrete by inserting into or placing onto the concrete, before it has set, a mechanical vibrator. The function of the vibrator is to vibrate the concrete so that air and voids are eliminated therefrom thereby to avoid the formation of undesirable pockets or honeycombs in the hardened concrete.

It has been found, unfortunately, that after a number of years the reinforcing rods may corrode thus weakening the thusly formed construction. This will especially happen under, for example, conditions whereby salt is spread in the winter to prevent the formation of ice. It will also happen due to the prevalence of acid rain and in ocean front structures, and so forth. To avoid the corrosion of reinforcing rods, they have been coated with a non-corrosive coating such as 0.005 to 0.010 inches of epoxy to shield them from the action of corrosive substances. This coating is frequently destroyed or marred upon being contacted by a vibrator which is being used as indicated above.

SUMMARY OF THE INVENTION

It is an object of the invention to provide improved vibrators and methods relating to the same.

It is another object of the invention to provide improved vibrators especially suited for operation adjacent to epoxy coated reinforcing rods and having characteristic features whereby the chipping of the coatings on reinforcing rods is avoided. It is yet another object of the invention to provide improved constructions for vibrators having enhanced features to avoid the overheating of the vibrators during operation.

It is still another object of the invention to provide improved vibrators especially suitable for use in avoiding pockets and honeycombs or the like in concrete.

Yet another object of the invention is to provide improved vibrators with characteristics to avoid the tendency to fling wet concrete from the vibrator surfaces.

Still another object of the invention is to provide improved vibrator constructions with special coverings while maintaining the vibration effectiveness of the structures which are thusly provided.

In achieving the above and other objects of the invention, there is provided in accordance with a preferred embodiment thereof, a vibrator construction which includes a relatively rigid shell within which is accommodated a vibrating mechanism which causes the shell to vibrate. A flexible shaft is preferably coupled to the vibrating mechanism to drive the same. Additionally, and in accordance with a feature of the invention, there is provided a cover on the shell which is formed of a material softer than the shell which may be, for example, fabricated of steel. The softer material lessens the effect of impact of the shell on any encountered object such as, for example, an epoxy-coated reinforcing rod.

The cover may be, for example, a perforated cover of a material such as rubber or the like. It will more preferably include a plurality of easily installed rings arranged in axial series, the rings including projections and being provided with receptacles for receiving the projections. The projections of respective of the rings will be engaged in the receptacles of the next adjacent rings in the axial series.

The projections mentioned above will preferably have an axial extent which is greater than the axial extent of the receptacles so that the rings are spaced from each other thereby providing between the rings passages for access to the shell. This, in turn, provides for a contact of the wet concrete with the shell for purposes of cooling the latter.

Each ring may, moreover, be provided with an internal surface defining a tapered bore through which the shell extends. The shell thus will make contact with the internal surface of the rings along not more than a portion of the respective bores. This also maximizes the contact of the wet and cooling cement with the surface of the associated shell.

In addition to the foregoing, a further feature of the invention finds the projections and receptacles mentioned above to be preferably of corresponding and generally trapezoidal cross-sections and the corners of the rings will advantageously be of champferred shape. The purpose of this is to minimize a flinging of the concrete or the like from the vibrating shell.

As will be seen hereinafter, the rings are of a resilient material which may be, for example, rubber or a blend of "Kevlar" and urethane.

The invention also provides a method which may be regarded as generally consisting of immersing coated reinforming rods in stiff fluid concrete and inserting a vibrator into the concrete to vibrate the same to remove entrapped air and voids. The method further comprises partly covering the vibrator with a material softer than the coating on the reinforcing rods. The vibrator is cooled by forming passages in the covering so that the concrete can contact the vibrator. As noted hereinabove, the covering is most preferably formed of axially spaced concentric rings which preferably are internally undercut to enhance the exposure of the vibrator to the cooling effects of the concrete. As will be shown in greater detail hereinafter, the vibrator is driven with an eccentric in a preferred version and the weight of the eccentric is preferably maximized with relatively heavy weight inserts.

Other objects, features and advantages of the invention will be found in the detailed description which follows hereinbelow as illustrated in the accompanying drawing.

DETAILED DESCRIPTION OF THE PREFERRED EMBODIMENTS

Figure 1:
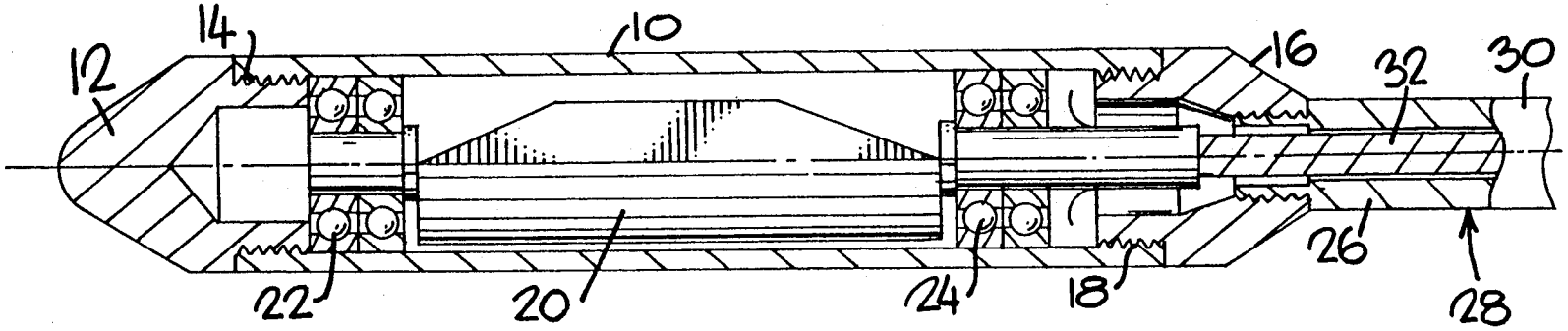
FIG-1- PRIOR ART
FIG. 1 is a side view, partially diagrammatic and partially in section, revealing a conventional construction of a vibrator of the prior art which can be modified in accordance with the invention.

As has been mentioned hereinabove, it is possible for the steel head or shell of a vibrator to strike reinforcing rods which are themselves provided with an epoxy coating. This results in the danger of cracking or chipping the epoxy thus exposing the steel to the corrosive effects of acid rain, water in which salt has been dissolved, and the like. In accordance with the invention, a general solution is to cover the steel vibrating shell with a material which is softer than the epoxy on the rods to be impacted or encountered. However, a generalization of this problem is to avoid distressing or ruining various types of coatings on any type of object which may be encountered by vibrators especially in a setting concrete environment.

A particular problem is that the eccentric rotor, accommodated in the vibrator shell, generally rotates at a relatively high speed such as, for example, 10,000–15,000 r.p.m. This generates a substantial amount of heat in the ball bearings and seals which are employed within the vibrator shell. To minimize this problem, the invention provides for maximizing the contact of the wet concrete with the vibrator shell thereby to cool the unit. The use of any soft non-conductive covering insulates the vibrator and tends to allow the temperature to rise above safe limits which, for example, may be regarded as being of the order of magnitude of approximately 350° F. To avoid this result, the cover for the vibrator shell is provided in accordance with the invention with passages as will be described in greater detail hereinbelow to maximize the contact of the wet concrete with the vibrator shell thereby to provide for optimum cooling.

A further problem is that vibrator heads range in diameter from 1 to 3 inches or the like. The larger is the outside diameter, the larger can be the rotating eccentric rotor, and the greater can be the resulting centrifugal force. When a vibrating unit or mechanism is covered with a soft material, the outside diameter has to be maintained. Therefore, the inside steel shell is reduced in diameter in relationship to the thickness of the cover. As a consequence, the eccentric rotor will have to be smaller and this results in a reduced centrifugal force and consequently a less effective concrete vibrator then would normally be provided. To overcome this, the static weight of the unit is reduced, and the steel shell can be made thinner since it does not directly impact encountered objects, and it does not wear by virtue of abrasion to the same extent as was previously known. In addition, the eccentric weight is maximized in a manner to be described hereinbelow.

Another problem which may be encountered is that centrifugal forces tend to stretch the cover which is furthermore stretched by virtue of the vibrating forces of the unit. To overcome this, the cover is provided with reinforcement of a nature to be described below.

Still another problem is that a cover when placed on a vibrating steel head or shell has the tendency to sling wet concrete off the vibrator surface. This occurs more when a cover is provided then would happen with respect to a smooth steel shell. To improve the flow of concrete from the vibrator head and surface when the head is withdrawn from the concrete, certain changes in the angles of the surfaces of the covering provided in accordance with the invention are employed to minimize the effect of parallel sides. As will be shown, the surfaces are angled to the direction of rotation. This may involve tapering the edges of the ring and tapering the sides of the projections on the rings as will be described in greater detail hereinbelow.

Referring next to FIG. 1, it is seen that a vibrating mechanism which is employed in accordance with the invention may include a conventional construction including a steel shell 10 of tubular form having associated therewith a steel nose 12 engaged with the tube or shell 10 by means of a thread indicated at 14. At the opposite extremity of the shell is provided a transition piece 16, also formed of steel and threadably engaged with the shell 10 by means of a thread indicated at 18.

Internally accommodated within the shell 10 is a rotating eccentric or rotor 20, the rotation of which is enabled by the provision of a seal and ball bearings such as indicated at 22 and 24. This enables a rotation of the eccentric 20 by means of a rotary source of power introduced through a steel coupling 26, and involving the use of a flexible shaft 28, including an outer casing 30 and an inner core 32.

The aforegoing structure is previously known, and its operation is well understood. The rotary power introduced by means of the flexible shaft inner core 32 is transmitted to the eccentric rotor 20 causing a rotation of the same. The eccentricity of the rotor causes the shell 10 to vibrate, and upon being inserted into a body of wet concrete, the concrete is vibrated thereby freeing the same of air inclusions and voids which tend to form pockets and/or honeycombs in the setting or set concrete body which is shaped by wooden forms of known construction.

Figure 2:
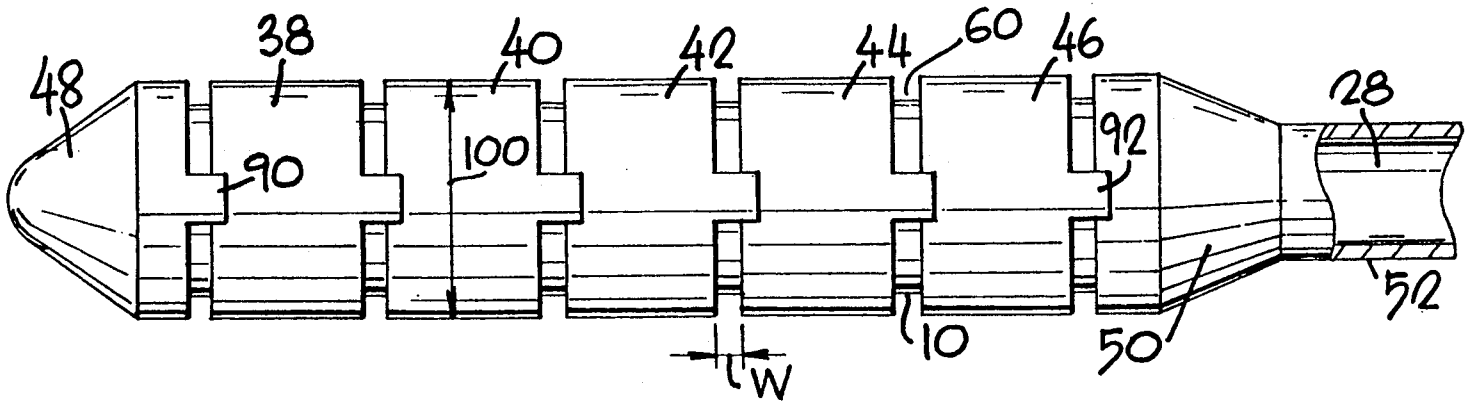
FIG. 2 is a side view partially in section showing the vibrator of FIG. 1 covered with relatively soft rings provided in accordance with the invention.

To avoid the effects of corrosion on the reinforcing rods which are embedded in the concrete, the vibrator in accordance with the invention is provided with a relatively soft cover or covering made, for example, of a relatively resilient material. Such a covering is illustrated in FIG. 2, wherein appears an axial series of rings 38, 40, 42, 44, and 46. Also provided is a soft molded nose piece 48 and a transition piece 50 enabling an adaption to accommodate the relatively smaller diameter of the flexible shaft which, as shown, is now covered by a soft tube 52 at the extremity of the same which is attached to the vibrator.

Figure 3:
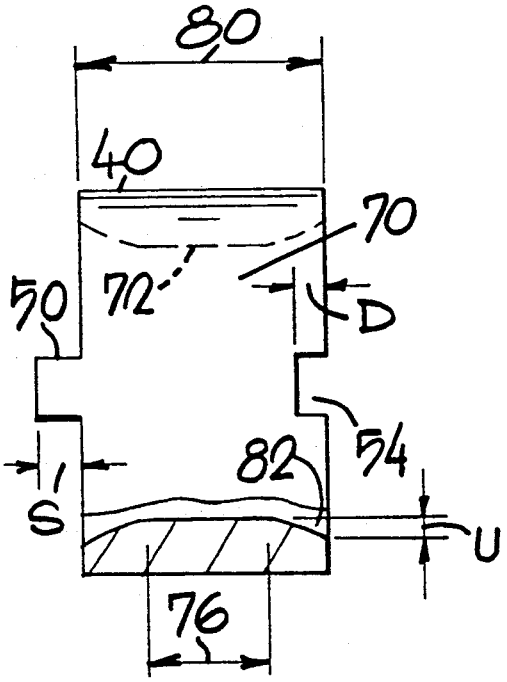
FIG. 3 is a side view of an individual ring as employed in FIG. 2 partially in hidden view to illustrate the internal surface of the bore of the ring.
Figure 4:
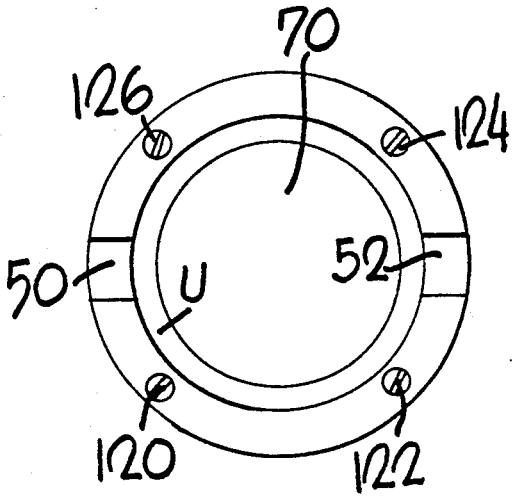
FIG. 4 is an end view of the ring of FIG. 3.

As appears more particularly in FIGS. 3 and 4, each ring, for example, the ring 40 is provided with a pair of projections 50 and 52, whose axial extent is indicated at S. Each ring is moreover provided with a pair of notches or receptacles such as indicated at 54. The axial extent of these notches is indicated at D. The axial extent of the projections is greater than the axial extent of the receptacles so that the rings are spaced from each other to form passages such as indicated at 60, in FIG. 2. These passages enable the surrounding concrete still in fluid form to make contact with the shell 10, thereby to make use of the cooling effect of the wet concrete for purposes of removing heat such as generated in the bearings 22 and 24 during the operation of the device. The width of these passages is indicated at W in FIG. 2, and this width, for example, may be in the range of 0.100 to 0.2500 inches as required and according to circumstances.

FIGS. 3 and 4, illustrate a further feature of the invention with respect to the bore 70 of each of the rings. Therein it will be seen that the internal surface 72 of each such ring is undercut as appears at U, thus minimizing the contact of each ring with the outer surface of the associated shell, the contacting internal surface being indicated at 76. This contacting portion of the internal surface of each ring with the shell 10 is preferably less than approximately 50% of the axial extent of the ring indicated at 80. The purpose of this is to enhance the penetration of the wet concrete into the space indicated at 82 in order to optimize the cooling effect which the wet concrete has on the surface of the shell 10, thereby to improve the removal of heat generated by the internal operation of the vibrator mechanism.

As will also be noted in FIG. 2, the conical nose 48 is provided with its own projection 90, whereas transition piece 50 is provided with its own receptacle 92, this enables these pieces to be included in the axial series which cooperatively encircles and covers the shell 10, thereby to minimize effect of impact with encountered objects such as the epoxy-coated steel reinforcing rods referred to hereinabove.

Figure 5:
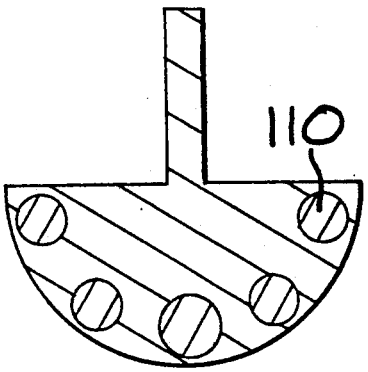
FIG. 5 reveals a cross-section of an eccentric of the construction of FIG. 1 modified for weight enhancement in accordance with the invention.
Figure 6:
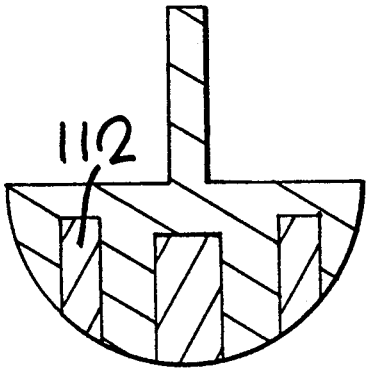
FIG. 6 is a corresponding view of a further possible modification of the eccentric.

As has been mentioned hereinabove, it is desirable to maintain the outer diameter of the unit such as indicated at 100 in FIG. 2. Thus, more particularly, even though a covering is provided on the vibrator mechanism of the invention, the dimension 100 should be maintained the same as it appears in FIG. 1. This means that the outer diameter of the tube or shell 10 has to be reduced, thereby reducing the size of the eccentric 20 contained therein. A smaller eccentric reduces the amount of vibrating force which is generated, and this is not desirable. FIGS. 5 and 6 are an illustration of two types of modifications which can be provided in the eccentric body to avoid the results of having a smaller rotor. Thus, for example, FIG. 5 illustrates that a plurality of round carbide rods can be embodied in the rotor as indicated at 110 thereby to maximize the weight of the associated body. Standard agreed carbide has a weight of almost two times that of standard agreed steel. Thus it will appear that the incorporation of round carbide rods into the rotor body will have a weight maximizing influence thereupon which, in turn, will enable the same amount of vibrating force to be generated even though a smaller rotor body is necessary. In FIG. 6, rectangular rods, i.e., rods having a rectangular cross-section, are employed. These are illustrated at 112 and are brazed into slots provided in the rotor body thereby also to have a weight maximizing effect. The rectangular rods 112 are also fabricated of a material such as carbide steel thereby to increase or maximize the resulting weight of the rotor body into which the rods are incorporated.

As has also been mentioned above, the reducing of the vibrator force which is generated may be overcome in part by decreasing the static weight of the various parts of the shell, nose, transition components, and so forth. It has been found that, in accordance with the invention, the steel shell can be made thinner and its thickness reduced by as much as an order of magnitude of 30%. This is possible since the shell no longer directly impacts encountered objects; and its wear, as a result of abrasion, is substantially decreased by virtue of the provision of the relatively soft covering. The thinner shell requires less of a vibrator force to enable the shell to accomplish its desired results.

To overcome the effects which the vibrating force has on the aforementioned rings, each ring may be provided with a plurality of reinforcing elements such as the axially aligned braids or rods indicated in FIG. 4 at 120, 122, 124, and 126. These reinforcements, which may be fabricated of metal, may also be accompanied or substituted for by means of metal rims or the like. In addition to being disposed in axial attitude as illustrated in FIG. 4, these inserts may also be formed as rings which circle through the bodies of the rings. Any configuration of these rings may be employed in accordance with the invention.

The rings of the invention may be reinforced as indicated above. In addition thereto, or perhaps in substitution of reinforcement, a special mixture may be substituted for rubber which constitutes one of the materials from which the rings of the invention may be formed. A possible substitution for the rubber is a mixture of "Kevlar" available from DuPont and urethane, which mixture has a relatively high tensile strength. This blend can be used by itself to improve the tensile strength of the rings or may be used in association with the type of insert which has been indicated hereinabove.

Figure 8:
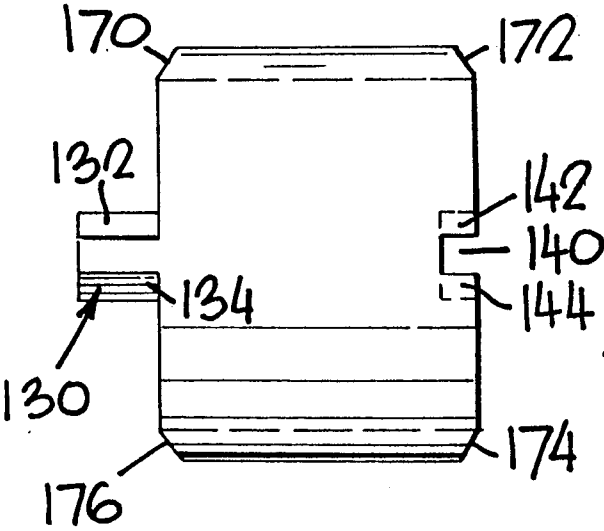
FIG. 8 is a side view of the ring of FIG. 7.
Figure 7:
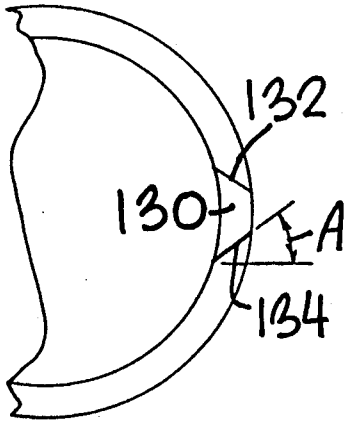
FIG. 7 is an end view of a fragment of a ring embodying a further improvement of the invention.

As has also been indicated hereinabove, rings placed upon vibrator heads or shells have a tendency to sling wet concrete off the vibrator surface and this occurs more on the covering surface than on the steel surface of the conventional shell. To improve the flow of concrete off the vibrator head surface when the header is withdrawn from the concrete, it is possible to change some angles of the surfaces to minimize the trapping effect of parallel sides. FIGS. 7 and 8 illustrate some of the improvements which can be provided for this purpose. Therein is seen a projection 130 having its cross-section generally in trapezoidal form. This trapezoidal cross-section has sloped sides 132 and 134 with the angle A of the side being, for example, in the order of magnitude of 45 degrees. It will be noted that the receptacle 140 associated therewith also has angularly disposed sides 142 and 144, the resulting receptacle therefore having a corresponding trapezoidal cross-section.

Figure 9:
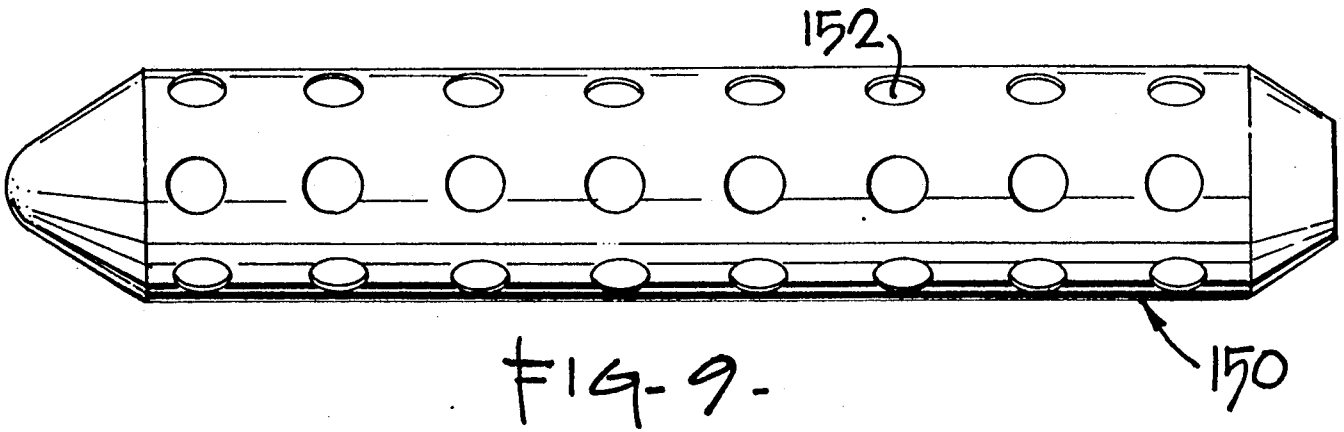
FIG. 9 is a diagrammatic view of a further type of covering which may be employed in accordance with the present invention.

Another solution to the problem of minimizing the effect of impacting encountered objects is illustrated in FIG. 9. Therein is shown a generally elastic and relatively soft covering 150 provided with perforations 152, intended for covering the associated shell of a vibrating mechanism. This cover can be fabricated of rubber or, for example, of the blend indicated hereinabove. The manufacturing of such a cover as illustrated in FIG. 9 may be simpler than that shown in FIGS. 1–8. The installation of such a cover, however, presents more production problems than encountered with the previously described embodiment and does not cool as effectively as the spaced-ring structure mentioned hereinabove.

From what has been described above, it is seen that a preferred embodiment of the invention involves the use of a relatively rigid shell with a vibrating mechanism therein and with a flexible shaft coupled to the vibrating mechanism to drive the same there being provided in accordance with a feature of the invention a cover of a material softer than the shell whereby to lessen the effect of impact of the shell on any encountered object. The cover preferably includes a plurality of rings in axial series arrangement. The rings include projections and are provided with receptacles whereby the rings may be inter-engaged in axially spaced relationship. As will be seen in FIG. 8, the outer edges of the respective rings may be champferred as indicated at 170, 172, 174, and 176. This feature also decreases the tendency of the vibrating unit to fling concrete off the surface thereof upon being withdrawn from the body of wet concrete into which the vibrator has been previously inserted.

In accordance with the invention, the material from which the rings or covering are made will be abrasion resistant and of relatively high tensile strength with minimized heat distortion. The rings may be made from the materials indicated above and will preferably have a Shore hardness of the order of magnitude of 40 on the D scale.

In accordance the invention, there is also provided, as will be understood from the above description, a method comprising immersing coated reinforcing rods into a stiff fluid concrete and inserting a vibrator into the concrete to vibrate the same to remove entrapped air and voids. The method will further incorporate partly covering the vibrator with a material softer than the coating of the reinforcing rods.

As a feature of the method of the invention, there is provided a cooling of the vibrator by forming passages in the covering so that the concrete can contact the vibrator to make use of the cooling effect of the wet concrete.

As has also been indicated hereinabove the covering can preferably be formed of axially spaced co-axial rings. Moreover, the rings can be internally undercut to enhance the exposure of the vibrator to the wet concrete. The driving of the vibrator can be enhanced by maximizing the weight of the eccentric by incorporating therein relatively heavy weight inserts.

Figure 10:
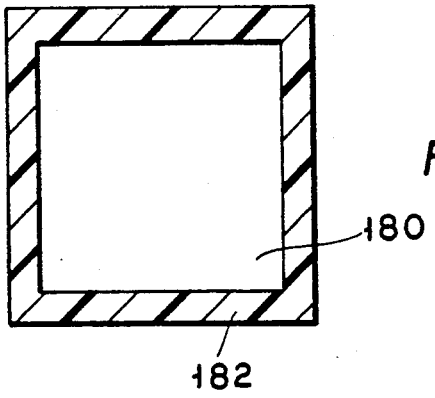
FIGS. 10–13 diagrammatically show alternative cross-sections for the construction of FIG. 2.
Figure 11:
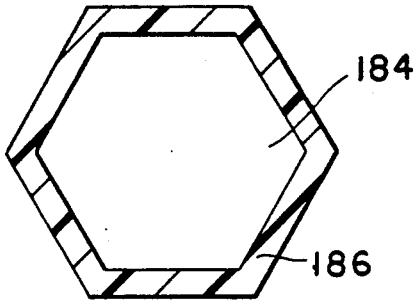
Figure 12:
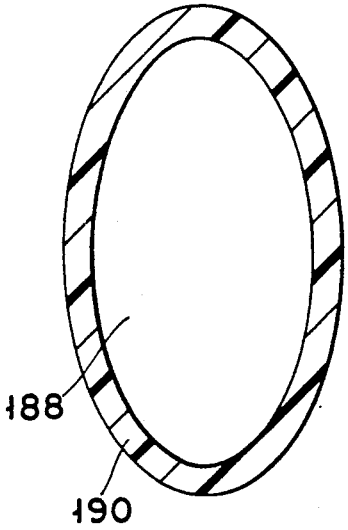
Figure 13:
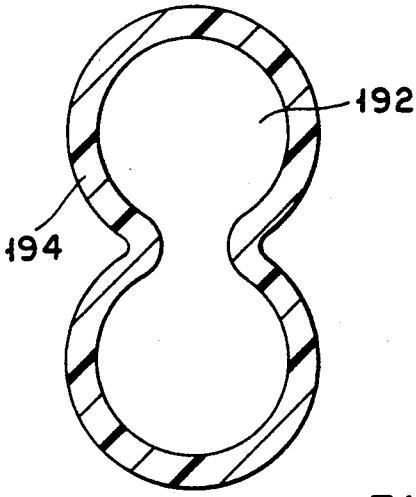

FIGS. 10–13 diagrammatically show cross-sections of constructions alternative to the round cross-section of FIG. 2. Thus, the vibrator and its shell can be of polygonal cross-section as shown in FIGS. 10 AND 11. FIG. 10 shows a quadrilaterally shaped (e.g., square or rectangular) vibrator and shell 180 with a correspondingly shaped cover 182 whereas FIG. 11 shows hexagonal vibrator and shell 184 with cover 186 This construction might also be, for example, octagonal. As other constructions, FIG. 12 shows an oval vibrator and shell 188 with cover 190 and FIG. 13 shows a two-lobed vibrator and shell 192 with a correspondingly shaped cover 194.

There will now be obvious to those skilled in the art, many modifications and variations of the constructions and methods set forth hereinabove. These modifications and variations will not depart from the scope of the invention if defined by the following claims.

What is claimed is:

1. A vibrator comprising a relatively rigid tubular shell, vibrating means within the shell to cause the shell to vibrate, a flexible shaft coupled to said vibrating means to drive the same, and covering means on said tubular shell of a material softer than said shell whereby to lessen the effects of impact of the shell on any encountered object, said covering means including a plurality of rings in axial series arrangement, said rings including projections and being provided with receptacles for receiving said projections, the projections of respective said rings being engaged in the receptacles of adjacent said rings in the said axial series.

2. A vibrator as claimed in claim 1, wherein said projections have an axial extent which is greater than the axial extent of the receptacles so that the rings are spaced from each other thereby defining between the rings passages for access to said shell.

3. A vibrator as claimed in claim 2, wherein each said ring is provided with an internal surface defining a tapered bore through which said shell extends, said shell making contact with the internal surface of the rings along not more than a portion of the respective bores.

4. A vibrator as claimed in claim 3, wherein said portion is less than approximately 50 percent of the axial extent of each said bore.

5. A vibrator as claimed in claim 2, wherein said shell is a generally tubular member and includes a conical nose and said covering means includes a conical member in series with said plurality of rings and covering said conical nose.

6. A vibrator as claimed in claim 2, wherein said projections and receptacles are of corresponding generally trapezoidal cross-sections.

7. A vibrator as claimed in claim 2, wherein said rings have outer corners which are of champferred shape.

8. A vibrator as claimed in claim 2, wherein said rings are of a resilient material.

9. A vibrator as claimed in claim 8, wherein said rings are of rubber.

10. A vibrator as claimed in claim 2 for use with concrete in which epoxy-covered reinforcing rods are located, said rings being of a material softer than said epoxy.

11. A vibrator as claimed in claim 2, wherein said vibrating means includes an eccentric, said eccentric including at least one weight-enhancing insert.

12. A vibrator as claimed in claim 2, wherein said rings include reinforcing means.

13. A vibrator as claimed in claim 2, wherein said shell is of a cross-section which is polygonal, round, oval, or multi-lobed.

* * * * *